United States Patent [19]

Jensen et al.

[11] Patent Number: 4,739,820

[45] Date of Patent: Apr. 26, 1988

[54] APPARATUS FOR SIMULTANEOUS MAKING OF MATCHING MOULD PARTS WITH A HORIZONTAL PARTING FACE

[75] Inventors: Claus T. Jensen, Hedehusene; Joern E. Johansen, Oelstykke; Haakon Kauserud, Ballerup, all of Denmark

[73] Assignee: Dansk Industri Syndikat A/S, Herlev, Denmark

[21] Appl. No.: 108,829

[22] PCT Filed: Feb. 24, 1987

[86] PCT No.: PCT/DK87/00017

§ 371 Date: Oct. 7, 1987

§ 102(e) Date: Oct. 7, 1987

[87] PCT Pub. No.: WO87/05239

PCT Pub. Date: Sep. 11, 1987

[30] Foreign Application Priority Data

Feb. 26, 1986 [DK] Denmark ..... 886/86

[51] Int. Cl.[4] ..... B22C 15/22; B22C 15/28

[52] U.S. Cl. ..... 164/160.1; 164/195

[58] Field of Search ..... 164/160.1, 7.1, 195, 164/38

[56] References Cited

U.S. PATENT DOCUMENTS 4,182,395 1/1980 Bühler ..... 164/160.1 X 4,620,584 11/1986 Witt ..... 164/160.1

*Primary Examiner*—Nicholas P. Godici

*Assistant Examiner*—J. Reed Batten, Jr.

*Attorney, Agent, or Firm*—Larson and Taylor

[57] ABSTRACT

The apparatus includes a shared pattern carrier (1), to which an upper and a lower half pattern (2, 3) are secured. Moulding chambers (4, 5) are provided above and below the pattern carrier (1), the moulding chambers having movable squeeze plates (6, 7) for post-compacting of the moulding material and forming top and bottom, respectively, in the moulding chambers. The moulding chambers (4, 5) can be impulsively subjected to vacuum for sucking in moulding material (8) through the squeeze plates (6, 7). The moulding material (8) is fed to the lower moulding chamber (5) through an essentially L-shaped down pipe (9), whose upper end (12) is connected with a materials container (10) above the moulding chambers (4, 5), and whose lower end (11) is connected with the squeeze plate (7) in the lower moulding chamber (5). The lower corner (14) of the L-shaped down pipe (9) is provided with at least one air intake opening (13). The air sucked in through the openings (13) reduces friction between the moulding material and the down pipe in the area where the moulding material tends to clot.

6 Claims, 1 Drawing Sheet

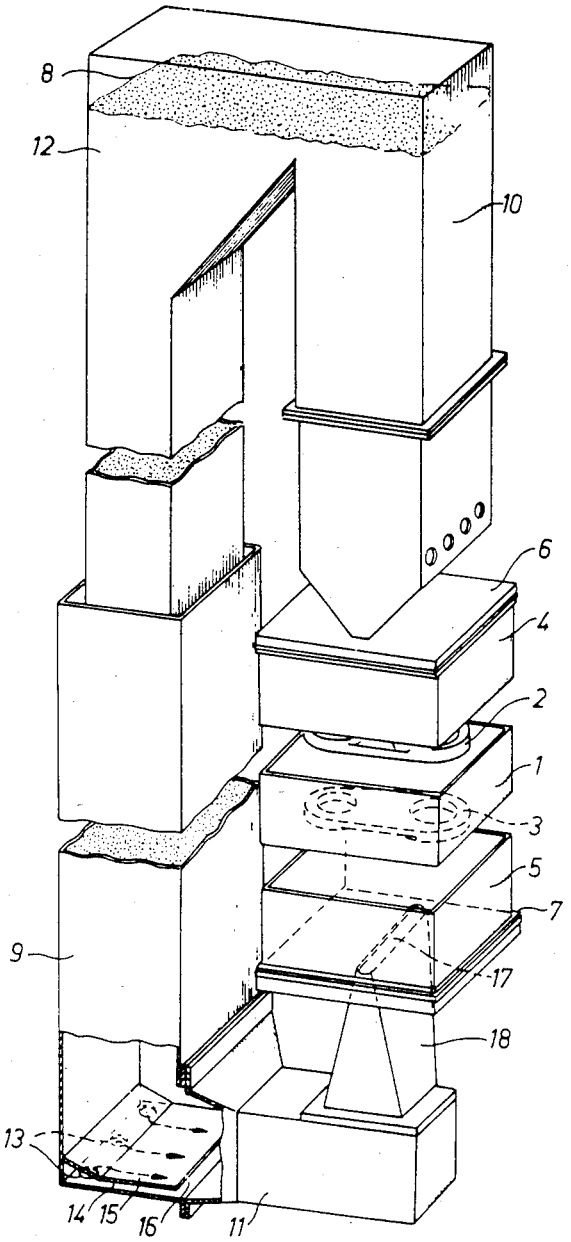
8
12
10
6
4
2
1
3
5
7
17
18
9
13
14
15
16
11

APPARATUS FOR SIMULTANEOUS MAKING OF MATCHING MOULD PARTS WITH A HORIZONTAL PARTING FACE

TECHNICAL FIELD

The invention relates to an apparatus for simultaneous making of matching mould parts with a horizontal parting face. The apparatus includes a shared pattern carrier, to which an upper and a lower half pattern are secured, moulding chambers being provided above and below the pattern carrier, said moulding chambers having movable squeeze plates for post-compacting as top and bottom, respectively, whereby the moulding chambers can be impulsively subjected to vacuum for sucking in moulding material, preferably moulding sand, through the squeeze plates, and whereby the moulding material is fed to the lower moulding chamber through an essentially L-shaped down pipe, whose upper end is connected with a materials container above the moulding chambers, and whose lower end is connected with the squeeze plate in the lower moulding chamber.

BACKGROUND ART

An apparatus of this type is known from German Patent Specification No. 2,653,788. However, it has been found that the vacuum provided in the moulding chambers is insufficient to overcome the friction in the moulding material, which is compacted in the lower portion of the down pipe. The weight of the moulding material in the down pipe will be added to the compressive force provided by the intake force from the moulding chamber under vacuum, which gives rise to caking of comparatively moist moulding material in particular.

SUMMARY OF THE INVENTION

The object of the invention is to provide a solution to the problem referred to above, so that a comparatively small vacuum in the moulding chamber will ensure satisfactory filling of the moulding chamber, meaning that when using post-compaction via the movable squeeze plate, mould parts with uniform density and strength are achieved.

According to the invention, this is achieved by an apparatus of the type described in the opening paragraph and characterized in that at least one air intake opening is provided at the lower corner of the L-shaped down pipe. Thus, it is possible to whirl up the moulding material in the area where it tends to cake, and the air quantity sucked in due to the vacuum will reduce friction between the moulding material and the side faces of the down pipe. It becomes feasible to use a comparatively tall down pipe, so that the weight of the moulding material in the pipe can be used to provide a compressive force, which—during the filling operation—will contribute to pressing the moulding material into the moulding chamber. This permits the use of a smaller vacuum than in apparatuses where the fall in the down pipe is smaller.

In an embodiment of an apparatus according to the invention, a screen plate is placed above intake openings, while forming a slot at the bottom of the down pipe in its entire width and opening towards the channel below the moulding chamber.

Placing a screen plate above the intake openings results in directional air intake through the openings, and during the impulsive intake of moulding material, a sort of air cushion will be generated at the bottom of the lower portion of the L-shaped down pipe, i.e. the channel below the moulding chamber. The friction between the moulding material and the bottom face of the channel is thus substantially reduced.

According to the invention, the inlet opening in the lower moulding chamber may be a slot provided centrally in the squeeze plate with a length equal to the moulding chamber.

It has been found that the provision of a centrally placed slot reduces friction in the connecting area between the moulding chamber and the inlet channel. The internal friction between the particles of the moulding material will give rise to a laminar flow through a comparatively narrow centre area, while a large opening equal to the cross-section of the flow channel will give rise to turbulent flow conditions.

In an embodiment preferred in practice, a connecting part tapered in V-shape is provided between the lower portion of the down pipe and the slot in the squeeze plate, said connecting part having a width equal to the slot.

This increases the tendency of laminar flow, and the part tapered in V-shape ensures that the moulding material is fed forwards with a minimum of friction against the side faces.

According to the invention, the central slot in the squeeze plate may be from 30 to 90 mm wide, preferably 55 mm.

Experiments have shown that slot widths within this interval provide satisfactory filling of the moulding chamber, and particularly favourable results have been achieved with a slot width of 55 mm.

BRIEF DESCRIPTION OF THE DRAWING

Ths invention will be explained in detail below with reference to the drawing, whose single FIGURE gives a schematic view of an apparatus designed according to the invention.

DESCRIPTION OF THE PREFERRED EMBODIMENT

The apparatus shown in the drawing consists of a telescopic down pipe 9, which forms a connecting channel between a container 10 for moulding material, preferably moulding sand, and a lower moulding chamber 5. The moulding material 8 is suggested by the wavy line in the container 10.

The materials container 10 is moreover connected with an upper moulding chamber 4.

A shared pattern carrier 1 is placed between the upper and the lower moulding chamber designated by 4 and 5, respectively, and to the said carrier are secured an upper and lower half pattern, designated by 2 and 3, respectively. The moulding chambers 4 and 5 are defined upwardly and downwardly by squeeze plates 6 and 7, which are provided with inlet openings 17 for the moulding material. The squeeze plates 6 and 7 can form closed moulding spaces jointly with the moulding chambers 4 and 5 and the lower side of the shared pattern carrier 1. Moulding sand or other moulding material is injected through the openings in the squeeze plates into the said moulding spaces by impulsive intake. The intake will be provided by applying vacuum through the shared pattern carrier and/or the sides of the moulding chamber.

After filling the moulding material, post-compaction is made by feeding the squeeze plates 6 and 7, respectively, towards the shared pattern carrier.

The squeeze plates are then moved away from the pattern carrier, which is removed from the area between the moulding chambers, and the two mould parts made are caused to close up so as to form a complete mould. Cores may have been inserted in advance in the mould impression provided in the mould parts.

At the bottom of the L-shaped down pipe 9, intake openings 13 are provided below the screen plate 15. The air sucked in through the openings 13 is discharged through a slot 16 between the screen plate 15 and the bottom of the down pipe, as indicated by the arrows. This generates a sort of air cushion, which "rinses" the bottom of the down pipe in its lower section 11.

The lower section 11 of the down pipe is connected with the lower moulding chamber 5 through a connecting part 18, tapered in V-shape in the direction of the slot 17 in the squeeze plate 7.

In the embodiment shown in the drawing, three circular air inlet openings 13 are provided at the lower corner of the L-shaped down pipe. Of course it is within the scope of the invention to use more air openings or fewer, and it might prove advantageous to use an elongated slot instead of several openings placed side by side. However, a decisive point is to provide a suitably high speed in the air sucked in through the openings, as the rinsing effect is established sufficiently quickly during the impulsive intake and is retained sufficiently long.

We claim:

1. An apparatus for simultaneous making of matching mould parts with a horizontal parting face, said apparatus including a shared pattern carrier (1), to which an upper and a lower half pattern (2,3) are secured, moulding chambers (4,5) being provided above and below the pattern carrier (1), said moulding chambers having movable upper and lower squeeze plates (6,7) for post-compacting as top and bottom, respectively, whereby the moulding chambers (4,5) are connected to a vacuum source for sucking in moulding material (8), preferably moulding sand, through the squeeze plates (6,7), and whereby the moulding material (8) is fed to the lower moulding chamber (5) through an essentially L-shaped down pipe (9), whose upper end (12) is connected with a materials container (10) above the moulding chambers (4,5), and whose lower end (11) is connected with the squeeze plate (7) in the lower moulding chamber (5), characterized in that at least one air intake opening (13) is provided at the lower corner (14) of the L-shaped down pipe (9).

2. An apparatus according to claim 1, characterized in that a screen plate (15) is placed above the intake openings (13) while forming a slot (16) at the bottom of the down pipe (9) in its entire width and opening towards the channel below the lower moulding chamber.

3. An apparatus according to claim 1, characterized in that the inlet opening in the lower moulding chamber (5) is a slot (17) provided centrally in the lower squeeze plate (7), with a length equal to the lower moulding chamber.

4. An apparatus according to claim 3, characterized in that a connecting part (18) tapered in V-shape in the direction of the slot (17) is provided between the lower portion (11) of the down pipe and the slot (17), said part having a width equal to the slot.

5. An apparatus according to claim 3, characterized in that the slot is from 30 to 90 mm wide.

6. An apparatus according to claim 5, wherein the slot is 55 mm wide.

* * * * *